US009037456B2

(12) United States Patent
Mittal et al.

(10) Patent No.: US 9,037,456 B2
(45) Date of Patent: May 19, 2015

(54) METHOD AND APPARATUS FOR AUDIO CODING AND DECODING

(75) Inventors: Udar Mittal, Bangalore (IN); James P. Ashley, Maperville, IL (US); Jonathan A. Gibbs, Windemere (GB)

(73) Assignee: GOOGLE TECHNOLOGY HOLDINGS LLC, Mountain View, CA (US)

( * ) Notice: Subject to any disclaimer, the term of this patent is extended or adjusted under 35 U.S.C. 154(b) by 528 days.

(21) Appl. No.: 13/190,517

(22) Filed: Jul. 26, 2011

(65) Prior Publication Data

US 2013/0030798 A1 Jan. 31, 2013

(51) Int. Cl.
*G10L 19/18* (2013.01)
*G10L 19/20* (2013.01)

(52) U.S. Cl.
CPC ..... *G10L 19/20* (2013.01)

(58) Field of Classification Search
USPC ..... 704/219
See application file for complete search history.

(56) References Cited

U.S. PATENT DOCUMENTS

| | | | | |
|---|---|---|---|---|
| 6,113,653 | A * | 9/2000 | Ashley et al. | 704/219 |
| 7,343,283 | B2 * | 3/2008 | Ashley et al. | 704/219 |
| 8,515,767 | B2 * | 8/2013 | Reznik | 704/500 |
| 2003/0009325 | A1 * | 1/2003 | Kirchherr et al. | 704/211 |
| 2005/0159942 | A1 | 7/2005 | Singhal | |
| 2006/0173675 | A1 | 8/2006 | Ojanpera | |
| 2009/0076829 | A1 * | 3/2009 | Ragot et al. | 704/500 |
| 2009/0240491 | A1 * | 9/2009 | Reznik | 704/219 |
| 2009/0259477 | A1 * | 10/2009 | Ashley et al. | 704/500 |
| 2010/0217607 | A1 * | 8/2010 | Neuendorf et al. | 704/500 |
| 2011/0173008 | A1 * | 7/2011 | Lecomte et al. | 704/500 |
| 2011/0218797 | A1 | 9/2011 | Mittal et al. | |

(Continued)

FOREIGN PATENT DOCUMENTS

| | | | |
|---|---|---|---|
| EP | 2144230 | A1 | 1/2010 |
| EP | 2144231 | A1 | 1/2010 |
| EP | 2214164 | A2 | 8/2010 |

(Continued)

OTHER PUBLICATIONS

Patent Cooperation Treaty, "PCT Search Report and Written Opinion of the International Searching Authority" for International Application No. PCT/US2012/047806 dated Oct. 26, 2012, 15 pages.

(Continued)

*Primary Examiner* — David Hudspeth
*Assistant Examiner* — Timothy Nguyen
(74) *Attorney, Agent, or Firm* — Birch, Stewart, Kolasch & Birch, LLP

(57) ABSTRACT

An encoder and decoder for processing an audio signal including generic audio and speech frames are provided herein. During operation, two encoders are utilized by the speech coder, and two decoders are utilized by the speech decoder. The two encoders and decoders are utilized to process speech and non-speech (generic audio) respectively. During a transition between generic audio and speech, parameters that are needed by the speech decoder for decoding frame of speech are generated by processing the preceding generic audio (non-speech) frame for the necessary parameters. Because necessary parameters are obtained by the speech coder/decoder, the discontinuities associated with prior-art techniques are reduced when transitioning between generic audio frames and speech frames.

7 Claims, 11 Drawing Sheets

(56) References Cited

U.S. PATENT DOCUMENTS

| | | | | |
|---|---|---|---|---|
| 2011/0218799 | A1* | 9/2011 | Mittal et al. | 704/203 |
| 2011/0238425 | A1* | 9/2011 | Neuendorf et al. | 704/500 |

FOREIGN PATENT DOCUMENTS

| | | | |
|---|---|---|---|
| KR | 10-2009-0035717 | | 4/2009 |
| KR | 10-2011-0043592 | | 4/2011 |
| KR | 10-2011-0052622 | | 5/2011 |
| WO | WO 2008/016945 | A2 | 2/2008 |
| WO | 2010003564 | A1 | 1/2010 |
| WO | 2010003663 | A1 | 1/2010 |
| WO | WO 2010/003491 | A1 | 1/2010 |

OTHER PUBLICATIONS

Mittal et al., "Method and Apparatus for Processing Aido Frames to Transition Between Difference Codecs" U.S. Appl. No. 13/342,462, filed Jan. 3, 2012, 34 pages.

Combescure et al., "A 16, 24, 32 Kbit/S Wideband Speech Codec Based on ATCELP" ICASSP '99 Proceedings of the Acoustics, Speech, and Signal Processing, 1999, pp. 5-8.

Andreas S. Spanias, "Speech Coding: A Tutorial Review", Proc. of the IEEE, Oct. 1994, pp. 1539-1582, vol. 82 No. 10.

Ted Painter and Andreas Spanias, "Perceptual Coding of Digital Audio", Proc. of the IEEE, Apr. 2000, pp. 451-513, vol. 88 No. 4.

3GPP TS 26.290 v10.0.0 (Mar. 2011), 3rd Generation Partnership Project; Technical Specification Group Services and system Aspects; Audio codec processing functions; Extended Adaptive Multi-Rate-Wideband (AMR-WB+) codec; Transcoding functions (Release 10), all pages.

Lecomte, Jeremie et al.: "Efficient cross-fade windows for transitions between LPC-based and non-LPC based audio coding", Audio Engineering Society, Convention Paper 7712, Presented at the 126th Convention, May 7-10, 2009 Munich, Germany, 9 pages.

3GPP2 C.S0014-D, Version 3.0, "Enhanced Variable Rate Codec, Speech Service Options 3, 68, 70, and 73 for Wideband Spread Spectrum Digital Systems", 3rd Generation Partnership Project 2 "3GPP2", Oct. 2010, all pages.

Korean Notice of Preliminary Rejection for Korean Patent Application No. 10-2014-7002124, with English translation dated Jan. 2, 2015.

* cited by examiner

100

200

FIG. 6 – Speech Encoder

FIG. 7 Decoder

200

FIG. 9 Encoder

METHOD AND APPARATUS FOR AUDIO CODING AND DECODING

FIELD OF THE DISCLOSURE

The present disclosure relates generally to speech and audio coding and decoding and, more particularly, to an encoder and decoder for processing an audio signal including generic audio and speech frames.

BACKGROUND

Many audio signals may be classified as having more speech like characteristics or more generic audio characteristics typical of music, tones, background noise, reverberant speech, etc. Codecs based on source-filter models that are suitable for processing speech signals do not process generic audio signals as effectively. Such codecs include Linear Predictive Coding (LPC) codecs like Code Excited Linear Prediction (CELP) coders. Speech coders tend to process speech signals well even at low bit rates. Conversely, generic audio processing systems such as frequency domain transform codecs do not process speech signals very well. It is well known to provide a classifier or discriminator to determine, on a frame-by-frame basis, whether an audio signal is more or less speech-like and to direct the signal to either a speech codec or a generic audio codec based on the classification. An audio signal processor capable of processing different signal types is sometimes referred to as a hybrid core codec. In some cases the hybrid codec may be variable rate, i.e., it may code different types of frames at different bit rates. For example, the generic audio frames which are coded using the transform domain are coded at higher bit rates and the speech-like frames are coded at lower bit rates.

The transitioning between the processing of generic audio frames and speech frames using speech and generic audio mode, respectively, is known to produce discontinuities. Transition from a CELP domain frame to a Transform domain frame has been shown to produce discontinuity in the form of an audio gap. The transition from transform domain to CELP domain results in audible discontinuities which have an adverse effect on the audio quality. The main reason for the discontinuity is the improper initialization of the various states of the CELP codec.

To circumvent this issue of state update, prior art codecs such as AMRWB+ and EVRCWB use LPC analysis even in the audio mode and code the residual in the transform domain. The synthesized output is generated by passing the time domain residual obtained using the inverse transform through a LPC synthesis filter. This process by itself generates the LPC synthesis filter state and the ACB excitation state. However, the generic audio signals typically do not conform to the LPC model and hence spending bits on the LPC quantization may result in loss of performance for the generic audio signals. Therefore a need exists for an encoder and decoder for processing an audio signal including generic audio and speech frames that improves audio quality during transitions between coding and decoding techniques.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. It will further be appreciated that certain actions and/or steps may be described or depicted in a particular order of occurrence while those skilled in the art will understand that such specificity with respect to sequence is not actually required. Those skilled in the art will further recognize that references to specific implementation embodiments such as "circuitry" may equally be accomplished via either on general purpose computing apparatus (e.g., CPU) or specialized processing apparatus (e.g., DSP) executing software instructions stored in non-transitory computer-readable memory. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION OF THE DRAWINGS

In order to alleviate the above-mentioned need, an encoder and decoder for processing an audio signal including generic audio and speech frames are provided herein. During operation, two encoders are utilized by the speech coder, and two decoders are utilized by the speech decoder. The two encoders and decoders are utilized to process speech and non-speech (generic audio) respectively. During a transition between generic audio and speech, parameters that are needed by the speech decoder for decoding frame of speech are generated by processing the preceding generic audio (non-speech) frame for the necessary parameters. Because necessary parameters are obtained by the speech coder/decoder, the discontinuities associated with prior-art techniques are reduced when transitioning between generic audio frames and speech frames.

Figure 1:
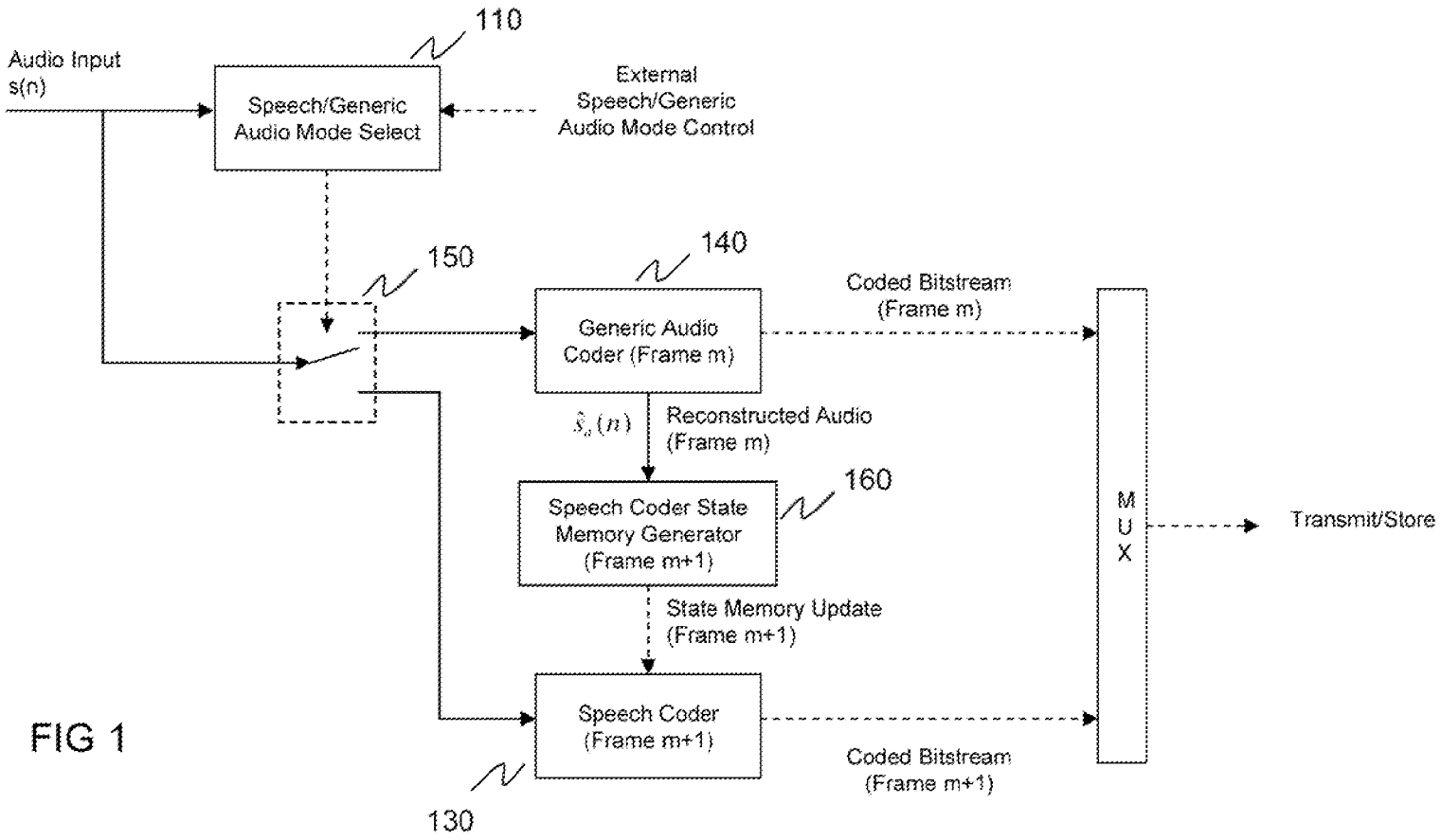
FIG. 1 illustrates a hybrid coder configured to code an input stream of frames some of which are speech like frames and others of which are less speech-like frames including non-speech frames.

Turning now to the drawings, where like numerals designate like components, FIG. 1 illustrates a hybrid coder 100 configured to code an input stream of frames some of which are speech like frames and others of which are less speech-like frames including non-speech frames. The circuitry of FIG. 1 may be incorporated into any electronic device performing encoding and decoding of audio. Such devices include, but are not limited to cellular telephones, music players, home telephones, . . . , etc.

The less speech-like frames are referred to herein as generic audio frames. The hybrid core codec 100 comprises a mode selector 110 that processes frames of an input audio signal s(n), where n is the sample index. The mode selector may also get input from a rate determiner which determines the rate for the current frame. The rate may then control the type of encoding method used. The frame lengths may comprise 320 samples of audio when the sampling rate is 16 kHz samples per second, which corresponds to a frame time interval of 20 milliseconds, although many other variations are possible.

In FIG. 1 first coder 130 suitable for coding speech frames is provided and a second coder 140 suitable for coding generic audio frames is provided. In one embodiment, coder 130 is based on a source-filter model suitable for processing speech signals and the generic audio coder 140 is a linear orthogonal lapped transform based on time domain aliasing cancellation (TDAC). In one implementation, speech coder 130 may utilize Linear Predictive Coding (LPC) typical of a Code Excited Linear Predictive (CELP) coder, among other coders suitable for processing speech signals. The generic audio coder may be implemented as Modified Discrete Cosine Transform (MDCT) coder or a Modified Discrete Sine Transform (MSCT) or forms of the MDCT based on different types of Discrete Cosine Transform (DCT) or DCT/Discrete Sine Transform (DST) combinations. Many other possibilities exist for generic audio coder 140.

In FIG. 1, first and second coders 130 and 140 have inputs coupled to the input audio signal by a selection switch 150 that is controlled based on the mode selected or determined by the mode selector 110. For example, switch 150 may be controlled by a processor based on the codeword output of the mode selector. The switch 150 selects the speech coder 130 for processing speech frames and the switch selects the generic audio coder for processing generic audio frames. Each frame may be processed by only one coder, e.g., either the speech coder or the generic audio coder, by virtue of the selection switch 150. While only two coders are illustrated in FIG. 1, the frames may be coded by one of several different coders. For example, one of three or more coders may be selected to process a particular frame of the input audio signal. In other embodiments, however, each frame may be coded by all coders as discussed further below.

Figure 2:
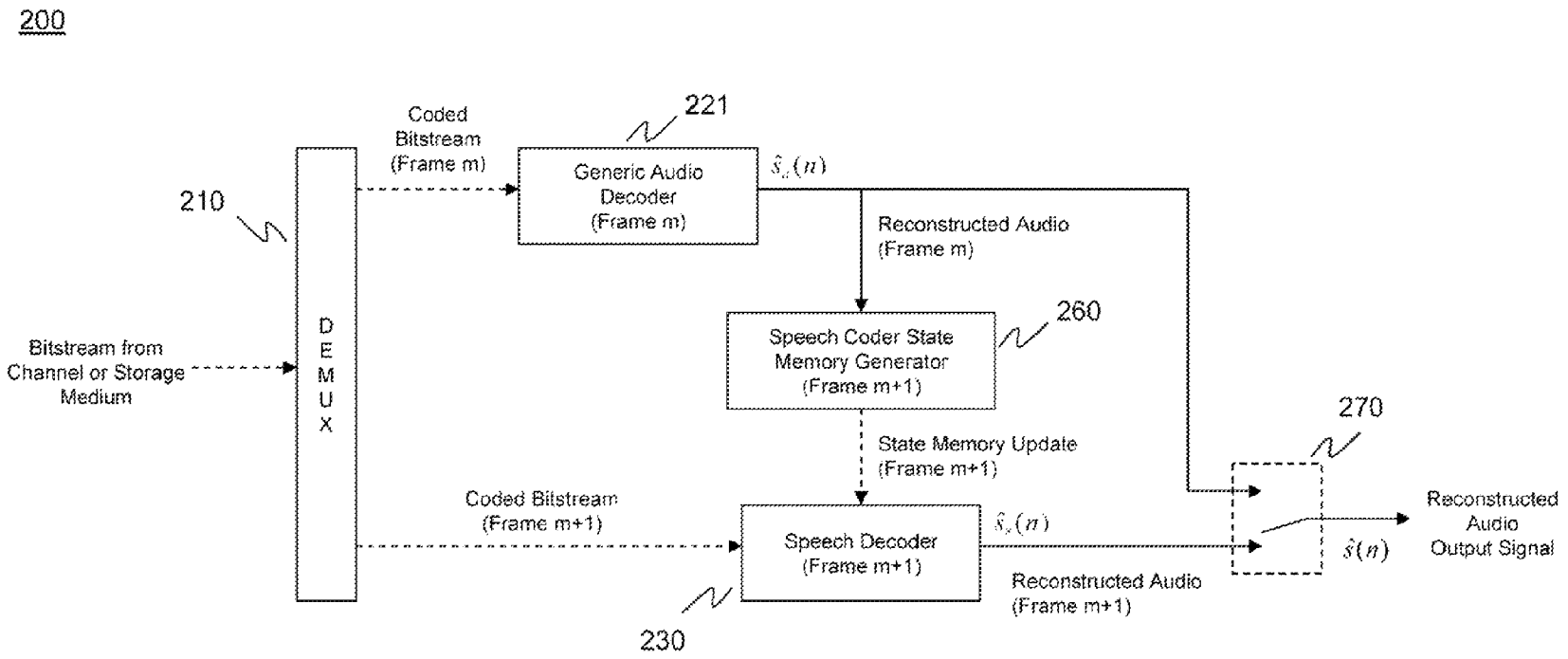
FIG. 2 is a block diagram of a speech decoder configured to decode an input stream of frames some of which are speech like frames and others of which are less speech-like frames including non-speech frames.

In FIG. 1, each codec produces an encoded bit stream and a corresponding processed frame based on the corresponding input audio frame processed by the coder. The encoded bit stream can then be stored or transmitted to an appropriate decoder 200 such as that shown in FIG. 2. In FIG. 2, the processed output frame produced by the speech decoder is indicated by $\hat{S}_s(n)$, while the processed frame produced by the generic audio coder is indicated by $\hat{S}_a(n)$.

As shown in FIG. 2, speech decoder 200 comprises a de-multiplexer 210 which receives the encoded bit stream and passes the bit stream to an appropriate decoder 230 or 221. Like encoder 100, decoder 200 comprises a first decoder 230 for decoding speech and a second decoder 221 for decoding generic audio. As mentioned above, when transitioning from the audio mode to the speech mode an audio discontinuity may be formed. In order to address this issue, parameter/state generator 160 and 260 are provided in both encoder 100 and decoder 200. During a transition between generic audio and speech, parameters and/or states (sometimes referred to as filter parameters) that are needed by speech encoder 130 and decoder 230 for encoding and decoding a frame of speech, respectively, are generated by generators 160 and 260 by processing the preceding generic audio (non-speech) frame output/decoded audio.

Figure 3:
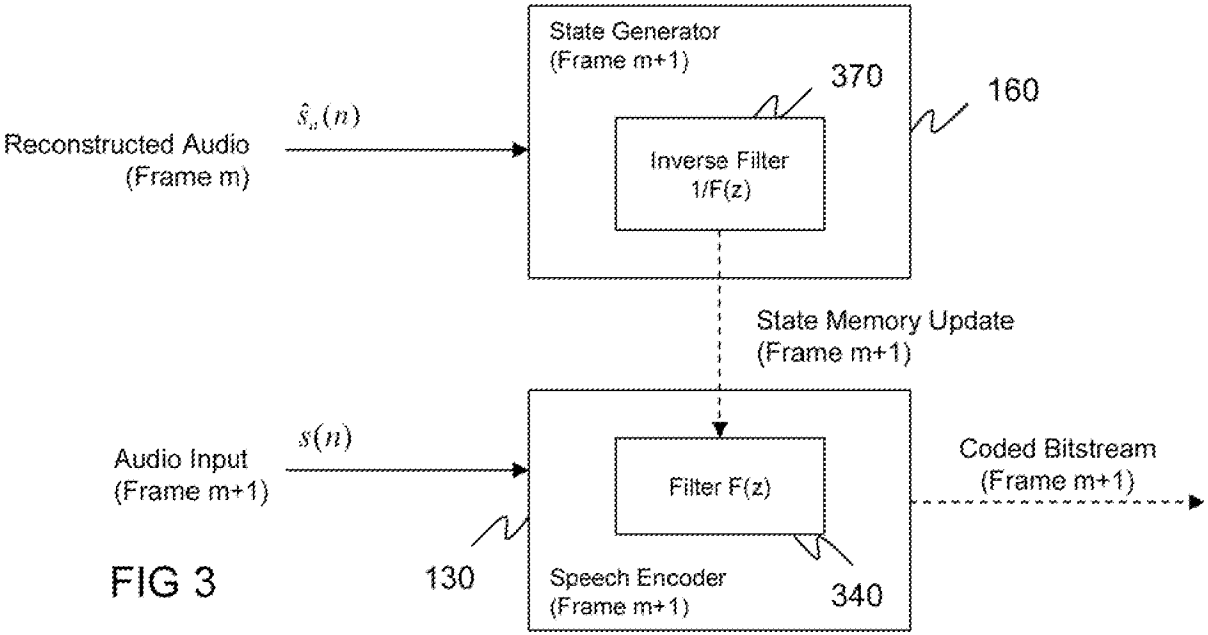
FIG. 3. is a block diagram of an encoder and a state generator.

FIG. 3 shows a block diagram of circuitry 160 and encoder 130. As shown, the reconstructed audio from the previously coded generic audio frame m enters state generator 160. The purpose of state generator 160 is to estimate one or more state memories (filter parameters) of speech encoder 130 for frame m+1 such that the system behaves as if frame m had been processed by speech encoder 130, when in fact frame m had been processed by a second encoder, such as the generic audio coder 140. Furthermore, as shown in 160 and 130, the filter implementations associated with the state memory update, filters 340 and 370, are complementary to (i.e., the inverse of) one another. This is due to nature of the state update process in the present invention. More specifically, the reconstructed audio of the previous frame m is "back-propagated" through the one or more inverse filters and/or other processes that are given in the speech encoder 130. The states of the inverse filter(s) are then transferred to the corresponding forward filter(s) in the encoder. This will result in a smooth transition from frame m to frame m+1 in the respective audio processing, and will be discussed in more detail later.

The subsequent decoded audio for frame m+1 may in this manner behave as it would if the previous frame m had been decoded by decoder 230. The decoded frame is then sent to state generator 160 where the parameters used by speech coder 130 are determined. This is accomplished, in part, by state generator 160 determining values for one or more of the following, through the use of the respective filter inverse function:

Down-sampling filter state memory,
Pre-emphasis filter state memory,
Linear prediction coefficients for interpolation and generation of the weighted synthesis filter, state memory
The adaptive codebook state memory,
De-emphasis filter state memory, and
LPC synthesis filter state memory.

Values for at least one of the above parameters are passed to speech encoder 130 where they are used as initialization states for encoding a subsequent speech frame.

Figure 4:
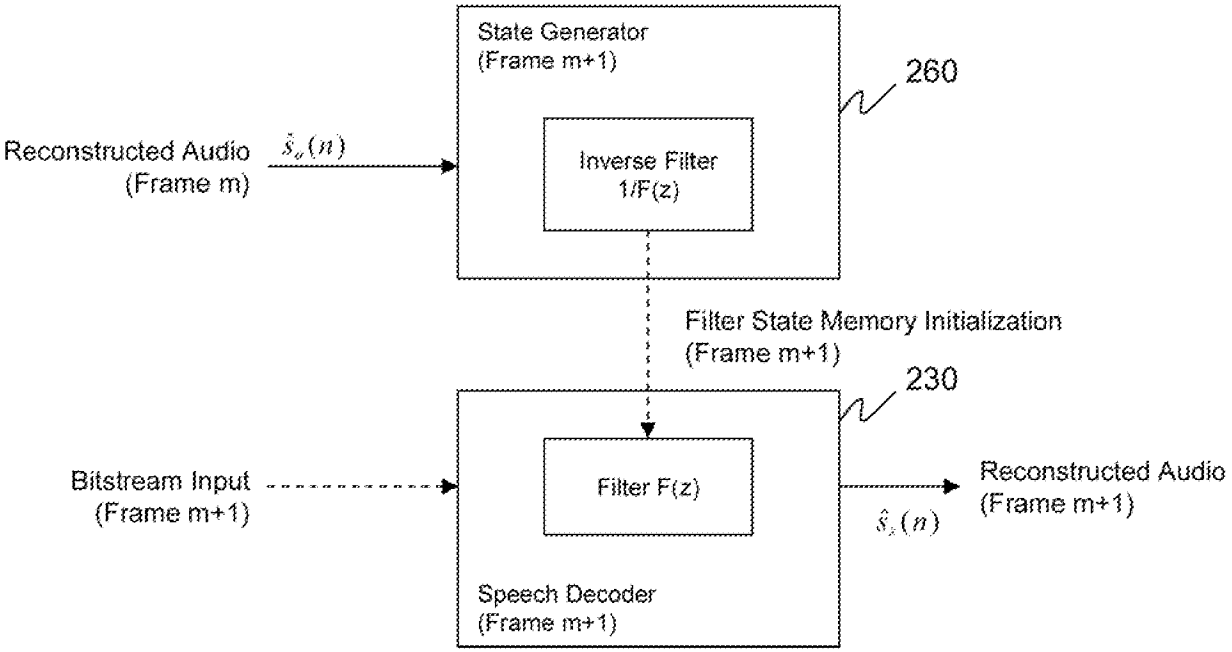
FIG. 4. is a block diagram of a decoder and a state generator.

FIG. 4 shows a corresponding decoder block diagram of state generator 260 and decoder 230. As shown, reconstructed audio from frame m enters state generators 260 where the state memory for filters used by speech decoder 230, are determined. This method is similar to the method of FIG. 3 in that the reconstructed audio of the previous frame m is "back-propagated" through the one or more filters and/or other processes that are given in the speech decoder 230 for processing frame m+1. The end result is to create a state within the filter(s) of decoder as if the reconstructed audio of the previous frame m were generated by the speech decoder 230, when in fact the reconstructed audio from the previous frame was generated from a second decoder, such as a generic audio decoder 230.

While the previous discussion exemplified the use of the invention with a single filter state F(z), we will now consider the case of a practical system in which state generators 160, 260 may include determining filter memory states for one or more of the following:

Re-sampling filter state memory
Pre-emphasis/de-emphasis filter state memory
Linear prediction (LP) coefficients for interpolation
Weighted synthesis filter state memory
Zero input response state memory
Adaptive codebook (ACB) state memory
LPC synthesis filter state memory
Postfilter state memory
Pitch pre-filter state memory Values for at least one of the above parameters are passed from state generators 160, 260 to the speech encoder 130 or speech decoder 230, where they are used as initialization states for encoding or decoding a respective subsequent speech frame.

Figure 5:
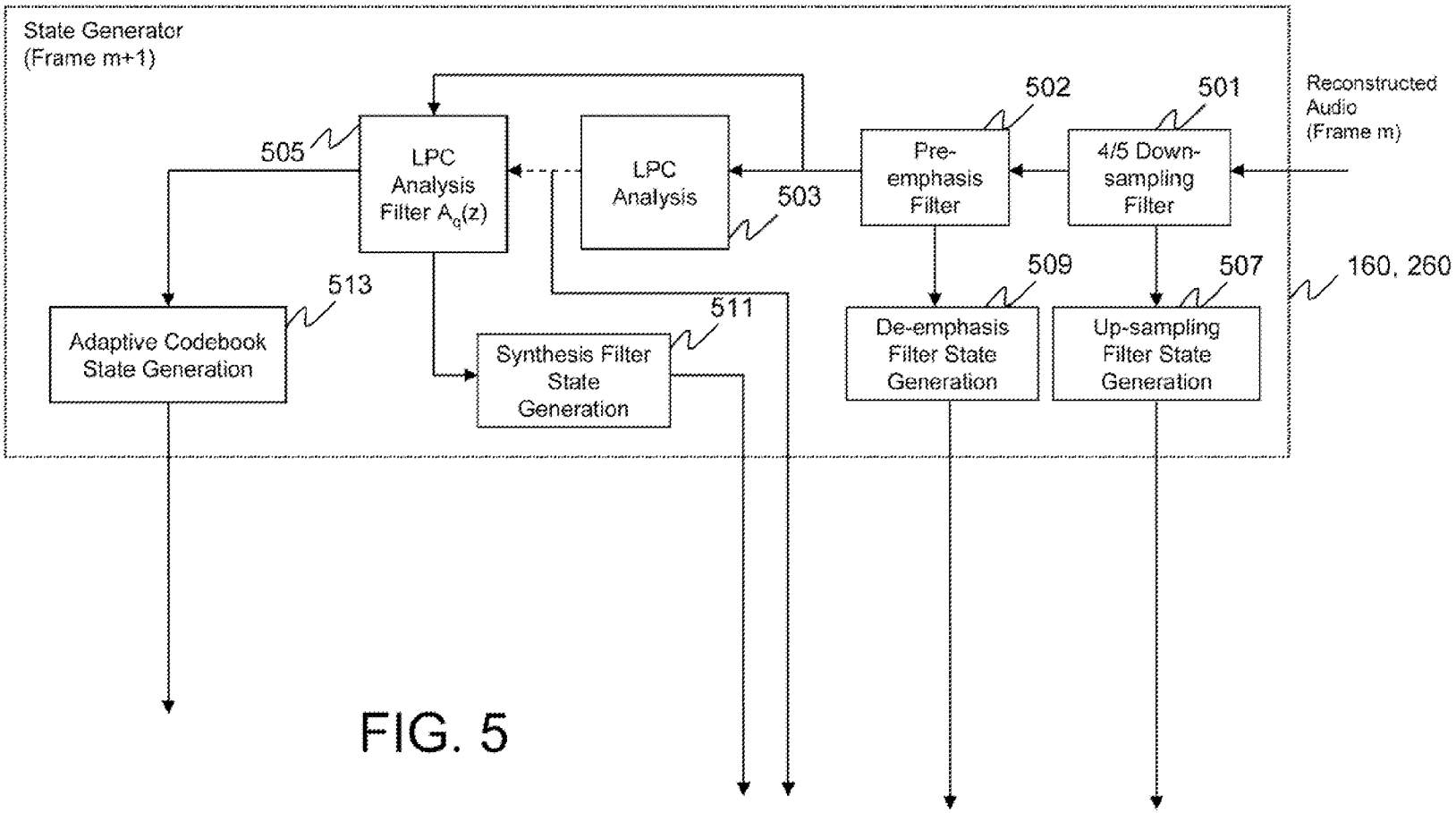
FIG. 5 is a more-detailed block diagram of a state generator.

FIG. 5 is a block diagram of state generator 160, 260, with elements 501, 502, and 505 acting as different embodiments of inverse filter 370. As shown, reconstructed audio for a frame (e.g., frame m) enters down-sampling filter 501 and is down sampled. The down sampled signal exits filter 501 and enters up-sampling filter state generation circuitry 507 where state of the respective up-sampling filter 711 of the decoder is determined and output. Additionally, the down sampled signal enters pre-emphasis filter 502 where pre-emphasis takes place. The resulting signal is passed to de-emphasis filter state generation circuitry 509 where the state of the de-emphasis filter 709 is determined and output. LPC analysis takes place via circuitry 503 and the LPC filter $A_q(z)$ is output to the LPC synthesis filter 707 as well as to the analysis filter 505 where the LPC residual is generated and output to synthesis filter state generation circuitry 511 where the state of the LPC synthesis filter 707 is determined and output. Depending upon the implementation of the LPC synthesis filter, the state of the LPC synthesis filter can be determined directly from the output of the pre-emphasis filter 502. Finally the output of LPC analysis filter is input to adaptive codebook state generation circuitry 513 where an appropriate codebook is determined and output.

Figure 6:
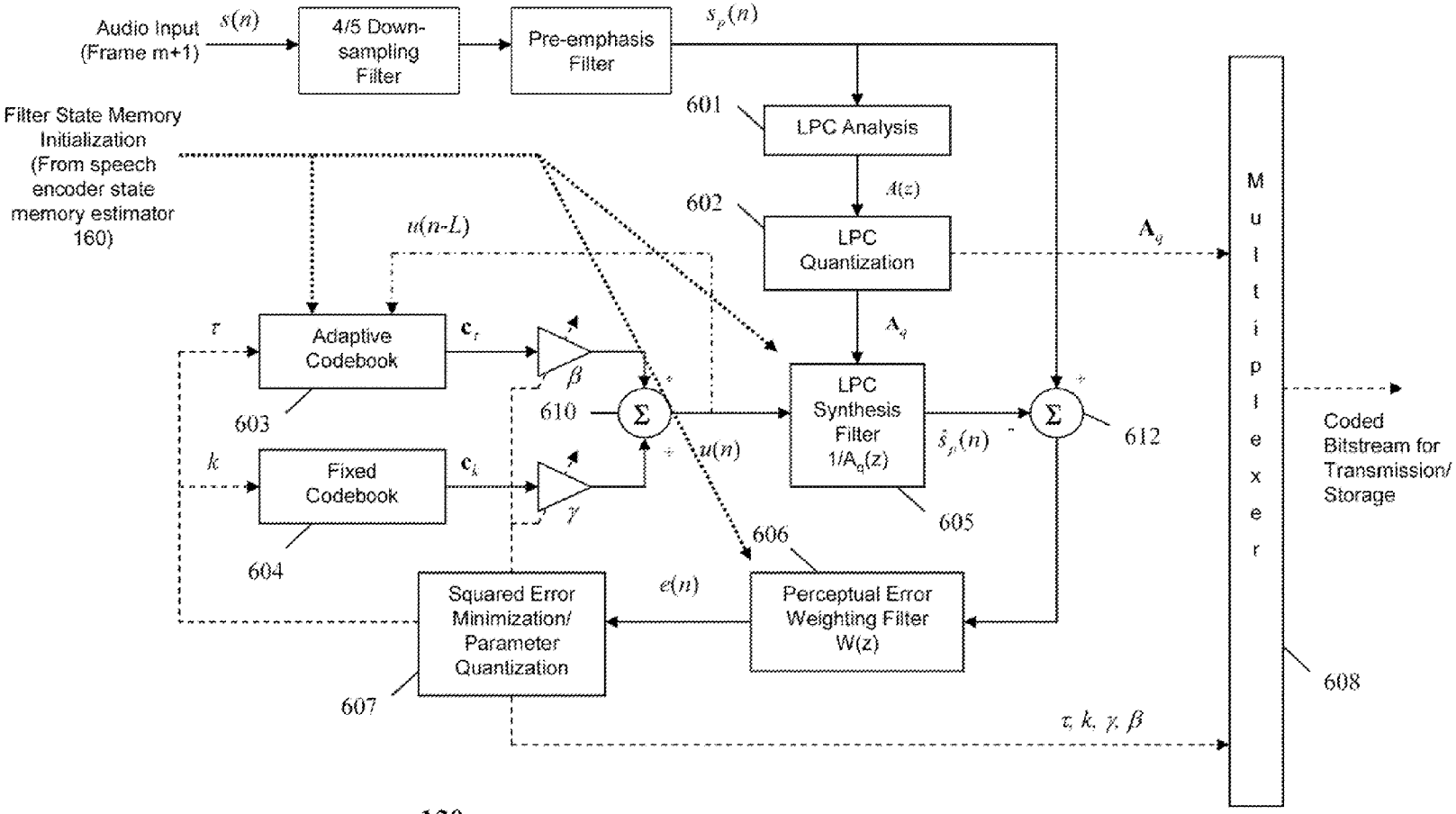
FIG. 6 is a more-detailed block diagram of a speech encoder.

FIG. 6 is a block diagram of speech encoder 130. Encoder 130 is preferably a CELP encoder 130. In CELP encoder 130, an input signal s(n) may be first re-sampled and/or pre-emphasized before being applied to a Linear Predictive Coding (LPC) analysis block 601, where linear predictive coding is used to estimate a short-term spectral envelope. The resulting spectral parameters (or LP parameters) are denoted by the transfer function A(z). The spectral parameters are applied to an LPC Quantization block 602 that quantizes the spectral parameters to produce quantized spectral parameters $A_q$ that are coded for use in a multiplexer 608. The quantized spectral parameters $A_q$ are then conveyed to multiplexer 608, and the multiplexer produces a coded bitstream based on the quantized spectral parameters and a set of codebook-related parameters $\tau$, $\beta$, k, and $\gamma$, that are determined by a squared error minimization/parameter quantization block 607.

The quantized spectral, or LP, parameters are also conveyed locally to an LPC synthesis filter 605 that has a corresponding transfer function $1/A_q(z)$. LPC synthesis filter 605 also receives a combined excitation signal u(n) from a first combiner 610 and produces an estimate of the input signal $\hat{s}_p(n)$ based on the quantized spectral parameters $A_q$ and the combined excitation signal u(n). Combined excitation signal u(n) is produced as follows. An adaptive codebook code-vector $c_\tau$ is selected from an adaptive codebook (ACB) 603 based on an index parameter $\tau$. The adaptive codebook code-vector $c_\tau$ is then weighted based on a gain parameter $\beta$ and the weighted adaptive codebook code-vector is conveyed to first combiner 610. A fixed codebook code-vector $c_k$ is selected from a fixed codebook (FCB) 604 based on an index parameter k. The fixed codebook code-vector $c_k$ is then weighted based on a gain parameter $\gamma$ and is also conveyed to first combiner 610. First combiner 610 then produces combined excitation signal u(n) by combining the weighted version of adaptive codebook code-vector $c_\tau$ with the weighted version of fixed codebook code-vector $c_k$.

LPC synthesis filter 605 conveys the input signal estimate $\hat{s}_p(n)$ to a second combiner 612. Second combiner 612 also receives input signal $s_p(n)$ and subtracts the estimate of the input signal $\hat{s}_p(n)$ from the input signal s(n). The difference between input signal $s_p(n)$ and input signal estimate $\hat{s}_p(n)$ is applied to a perceptual error weighting filter 606, which filter produces a perceptually weighted error signal e(n) based on the difference between $\hat{s}_p(n)$ and $s_p(n)$ and a weighting function W(z). Perceptually weighted error signal e(n) is then conveyed to squared error minimization/parameter quantization block 607. Squared error minimization/parameter quantization block 607 uses the error signal e(n) to determine an optimal set of codebook-related parameters $\tau$, $\beta$, k, and $\gamma$ that produce the best estimate $\hat{s}_p(n)$ of the input signal $s_p(n)$.

As shown, adaptive codebook 603, synthesis filter 605, and perceptual error weighting filter 606, all have inputs from state generator 160. As discussed above, these elements 603, 605, and 606 will obtain original parameters (initial states) for a first frame of speech from state generator 160, based on a prior non-speech audio frame.

Figure 7:
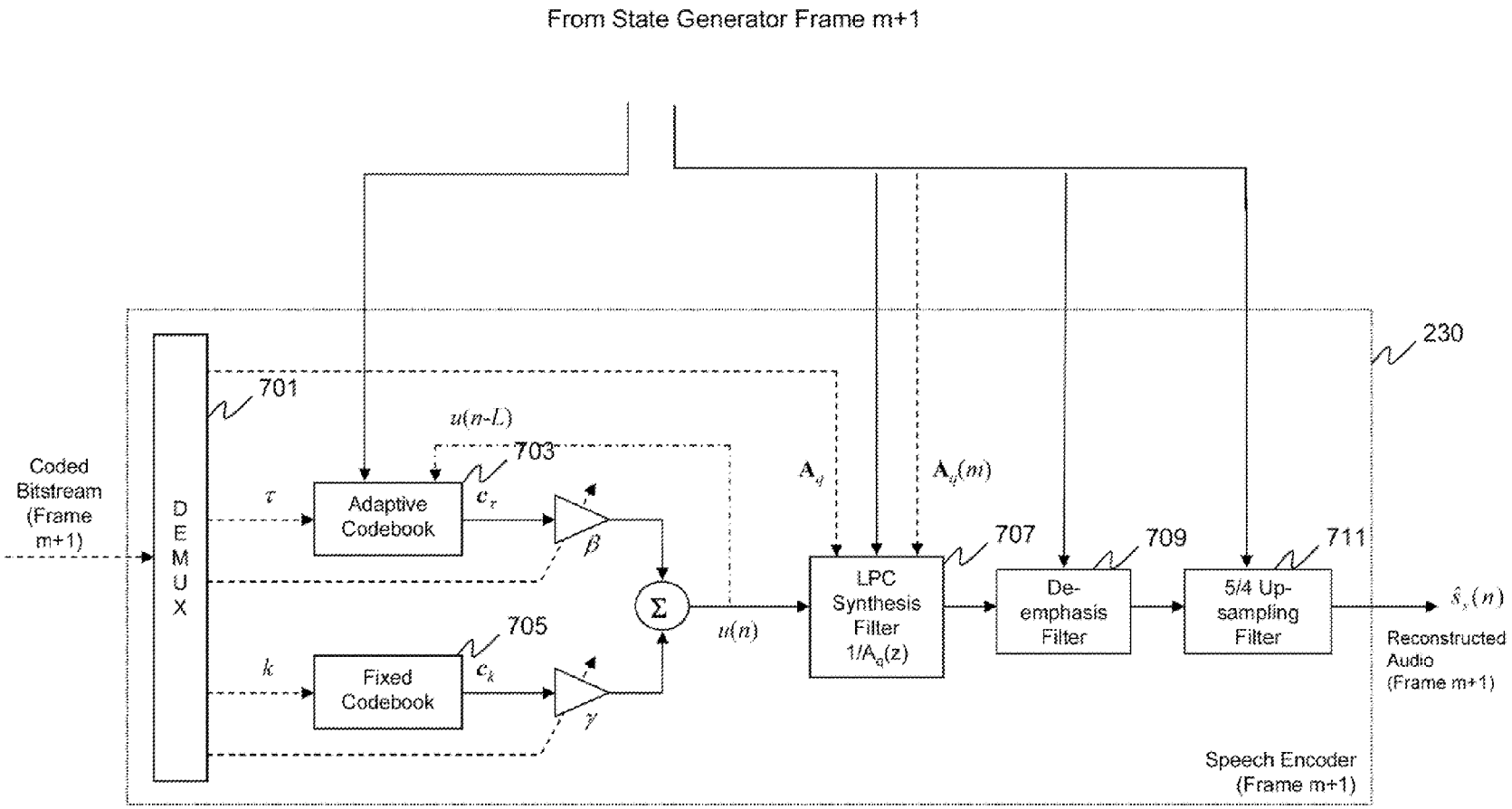
FIG. 7 is a more-detailed block diagram of a speech decoder.

FIG. 7 is a block diagram of a decoder 230. As shown, decoder 230 comprises demultiplexer 701, adaptive codebook 703, fixed codebook 705, LPC synthesis filter 707, de-emphasis filter 709, and upsampling filter 711. During operation the coded bitstream produced by encoder 130 is used by demultiplexer 701 in decoder 230 to decode the optimal set of codebook-related parameters, that is, $A_q$, $\tau$, $\beta$, k, and $\gamma$, in a process that is identical to the synthesis process performed by encoder 130.

The output of the synthesis filter 707, which may be referred as the output of the CELP decoder, is de-emphasized by filter 709 and then the de-emphasized signal is passed through a 12.8 kHz to 16 kHz up sampling filter (5/4 up sampling filter 711). The bandwidth of the synthesized output thus generated is limited to 6.4 kHz. To generate an 8 kHz bandwidth output, the signal from 6.4 kHz to 8 kHz is generated using a 0 bit bandwidth extension. The AMRWB type codec is mainly designed for wideband input (8 kHz bandwidth, 16 kHz sampling rate), however, the basic structure of AMRWB shown in FIG. 7 can still be used for super-wideband (16 kHz bandwidth, 32 kHz sampling rate) input and full band input (24 kHz bandwidth, 48 kHz sampling). In these scenarios, the down-sampling filter at the encoder will down sample from 32 kHz and 48 kHz sampling to 12.8 kHz, respectively. The zero bit bandwidth extension may also be replaced by a more elaborate bandwidth extension method.

The generic audio mode of the preferred embodiment uses a transform domain/frequency domain codec. The MDCT is used as a preferred transform. The structure of the generic audio mode may be like the transform domain layer of ITU-T Recommendation G.718 or G.718 super-wideband extensions. Unlike G.718, where in the input to the transform domain is the error signal from the lower layer, the input to the transform domain is the input audio signal. Furthermore, the transform domain part directly codes the MDCT of the input signal instead of coding the MDCT of the LPC residual of the input speech signal.

As mentioned, during a transition from generic audio coding to speech coding, parameters and state memories that are needed by the speech decoder for decoding a first frame of speech are generated by processing the preceding generic audio (non-speech) frame. In the preferred embodiment, the speech codec is derived from an AMR-WB type codec wherein the down-sampling of the input speech to 12.8 kHz is performed. The generic audio mode codec may not have any down sampling, pre-emphasis, and LPC analysis, so for encoding the frame following the audio frame, the encoder of the AMR-WB type codec may require initialization of the following parameters and state memories:

Down-sampling filter state memory,

Pre-emphasis filter state memory,

Linear prediction coefficients for interpolation and generation of the weighted synthesis filter, state memory The adaptive codebook state memory, De-emphasis filter state memory, and LPC synthesis filter state memory.

The state of the down sampling filter and pre-emphasis filter are needed by the encoder only and hence may be obtained by just continuing to process the audio input through these filters even in the generic audio mode. Generating the states which are needed only by the encoder 130 is simple as the speech part encoder modules which update these states can also be executed in the audio coder 140. Since the complexity of the audio mode encoder 140 is typically lower than the complexity of the speech mode encoder 130, the state processing in the encoder during the audio mode does to affect the worst case complexity.

The following states are also needed by decoder 230, and are provided by state generator 260.

1. Linear prediction coefficients for interpolation and generation of the synthesis filter state memory. This is provided by circuitry 611 and input to synthesis filter 707.
2. The adaptive codebook state memory. This is produced by circuitry 613 and output to adaptive codebook 703.
3. De-emphasis filter state memory. This is produced by circuitry 609 and input into de-emphasis filter 709.
4. LPC synthesis filter state memory. This is output by LPC analysis circuitry 603 and input into synthesis filter 707.
5. Up sampling filter state memory. This is produced by circuitry 607 and input to up-sampling filter 711.

The audio output $\hat{s}_a(n)$ is down-sampled by a 4/5 down sampling filter to produce a down sampled signal $\hat{s}_a(n_d)$. The down-sampling filter may be an IIR filter or an FIR filter. In the preferred embodiment, a linear time FIR low pass filter is used as the down-sampling filter, as given by:

$$H_{LP}(z) = \sum_{i=0}^{L-1} b_i z^{-i},$$

where $b_i$ are the FIR filter coefficients. This adds delay to the generic audio output. The last L samples as $\hat{s}_a(n_d)$ forms the state of the up sampling filter, where L is the length of the up-sampling filter. The up-sampling filter used in the speech mode to up-sample the 12.8 kHz CELP decoder output to 16 kHz. For this case, the state memory translation involves a simple copy of the down-sampling filter memory to the up-sampling filter. In this respect, the up-sampling filter state is initialized for frame m+1 as if the output of the decoded frame m had originated from the coding method of frame m+1, when in fact a different coding method for coding frame m was used.

The down sampled output $\hat{s}_a(n_d)$ is then passed through a pre-emphasis filter given by:

$$P(z)=1-\gamma z^{-1},$$

where $\gamma$ is a constant (typically $0.6 \le \gamma \le 0.9$), to generate a pre-emphasized signal $\hat{s}_{ap}(n_d)$. In the coding method for frame m+1, the pre-emphasis is performed at the encoder and the corresponding inverse (de-emphasis), $$D(z) = \frac{1}{1-\gamma z^{-1}},$$

is performed at the decoder. In this case, the down-sampled input to the pre-emphasis filter for the reconstructed audio from frame m is used to represent the previous outputs of the de-emphasis filter, and therefore, the last sample of $\hat{s}_a(n_d)$ is used as the de-emphasis filter state memory. This is conceptually similar to the re-sampling filters in that the state of the de-emphasis filter for frame m+1 is initialized to a state as if the decoding of frame m had been processed using the same decoding method as frame m+1, when in fact they are different.

Next, the last p samples of $\hat{s}_{ap}(n_d)$ are similarly used as the state of the LPC synthesis filter for the next speech mode frame, where p is the order of the LPC synthesis filter. The LPC analysis is performed on pre-emphasized output to generate "quantized" LPC of the previous frame, $$A_q(z) = 1 - \sum_{i=1}^{p} a_i z^{-1}.$$

and where the corresponding LPC synthesis filter is given by:

$$1/A_q(z) = \frac{1}{1-\sum_{i=1}^{p} a_i z^{-i}}.$$

In the speech mode, the synthesis/weighting filter coefficients of different subframes are generated by interpolation of the previous frame and the current frame LPC coefficients. For the interpolation purposes, if the previous frame is an audio mode frame, the LPC filter coefficients $A_q(z)$ obtained by performing LPC analysis of the $\hat{s}_{ap}(n_d)$ are now used as the LP parameters of the previous frame. Again, this is similar to the previous state updates, wherein the output of frame m is "back-propagated" to produce the state memory for use by the speech decoder of frame m+1.

Finally, for speech mode to work properly we need to update the ACB state of the system. The excitation for the audio frame can be obtained by a reverse processing. The reverse processing is the "reverse" of a typical processing in a speech decoder wherein the excitation is passed through a LPC inverse (i.e. synthesis) filter to generate an audio output. In this case, the audio output $\hat{s}_{ap}(n_d)$ is passed through a LPC analysis filter $A_q(z)$ to generate a residue signal. This residue is used for the generation of the adaptive codebook state.

Figure 8:
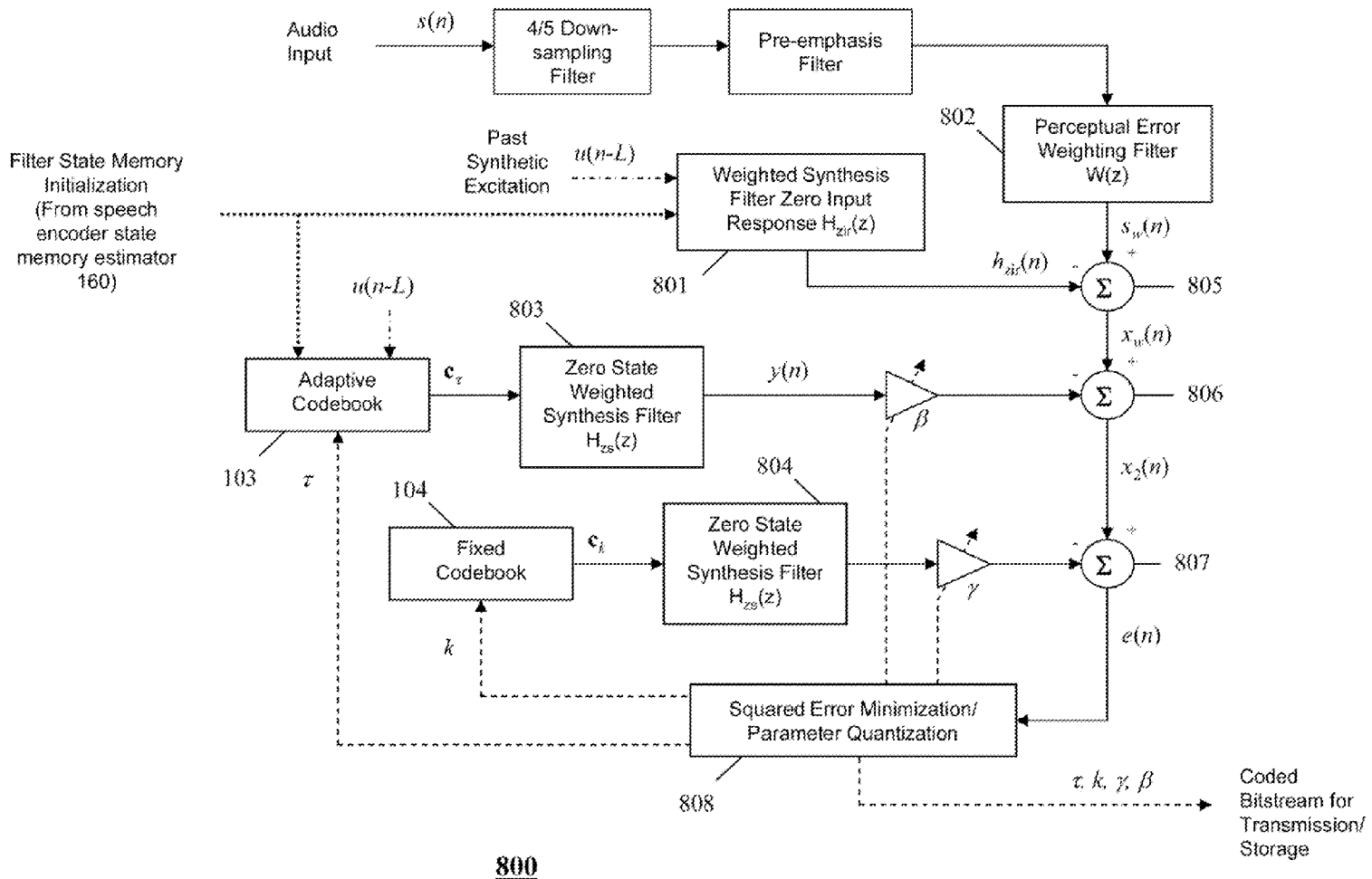
FIG. 8 is a block diagram of a speech encoder in accordance with an alternate embodiment.

While CELP encoder 130 is conceptually useful, it is generally not a practical implementation of an encoder where it is desirable to keep computational complexity as low as possible. As a result, FIG. 8 is a block diagram of an exemplary encoder 800 that utilizes an equivalent, and yet more practical, system to the encoding system illustrated by encoder 130. Encoder 800 may be substituted for encoder 130. To better understand the relationship between encoder 800 and encoder 130, it is beneficial to look at the mathematical derivation of encoder 800 from encoder 130. For the convenience of the reader, the variables are given in terms of their z-transforms.

From FIG. 6, it can be seen that perceptual error weighting filter 606 produces the weighted error signal e(n) based on a difference between the input signal and the estimated input signal, that is:

$$E(z)=W(z)(S(z)-\hat{S}z)). \tag{1}$$

From this expression, the weighting function W(z) can be distributed and the input signal estimate ŝ(n) can be decomposed into the filtered sum of the weighted codebook code-vectors:

$$E(z) = W(z)S(z) - \frac{W(z)}{A_q(z)}(\beta C_\tau(z) + \gamma C_k(z)). \tag{2}$$

The term W(z)S(z) corresponds to a weighted version of the input signal. By letting the weighted input signal W(z)S(z) be defined as $S_{iv}(z)=W(z)S(z)$ and by further letting weighted synthesis filter 803/804 of encoder 130 now be defined by a transfer function $H(z)=W(z)/A_q(z)$. In case the input audio signal is down sampled and pre-emphasized, then the weighting and error generation is performed on the down sampled speech input. However, a de-emphasis filter D(z), need to be added to the transfer function, thus $H(z)=W(z)\cdot D(z)/A_q(z)$ Equation 2 can now be rewritten as follows:

$$E(z)=S_w(z)-H(z)(\beta C_r(z)+\gamma C_k(z)). \tag{3}$$

By using z-transform notation, filter states need not be explicitly defined. Now proceeding using vector notation, where the vector length L is a length of a current subframe, Equation 3 can be rewritten as follows by using the superposition principle:

$$e=s_w-H(\beta c_r+\gamma c_k)-h_{zir}, \tag{4}$$

where:

H is the L×L zero-state weighted synthesis convolution matrix formed from an impulse response of a weighted synthesis filter h(n), such as synthesis filters 803 and 804, and corresponding to a transfer function $H_{zs}(z)$ or H(z), which matrix can be represented as:

$$H = \begin{bmatrix} h(0) & 0 & \dots & 0 \\ h(1) & h(0) & \dots & 0 \\ \vdots & \vdots & \ddots & \vdots \\ h(L-1) & h(L-2) & \dots & h(0) \end{bmatrix}, \tag{5}$$

$h_{zir}$ is a L×1 zero-input response of H(z) that is due to a state from a previous input, $s_w$ is the L×1 perceptually weighted input signal, β is the scalar adaptive codebook (ACB) gain, $c_\gamma$ is the L×1 ACB code-vector in response to index τ, γ is the scalar fixed codebook (FCB) gain, and $c_k$ is the L×1 FCB code-vector in response to index k.

By distributing H, and letting the input target vector $x_w=s_w-h_{zir}$, the following expression can be obtained:

$$e=x_w-\beta Hc_\tau-\gamma Hc_k. \tag{6}$$

Equation 6 represents the perceptually weighted error (or distortion) vector e(n) produced by a third combiner 807 of encoder 130 and coupled by combiner 807 to a squared error minimization/parameter block 808.

From the expression above, a formula can be derived for minimization of a weighted version of the perceptually weighted error, that is, $\|e\|^2$, by squared error minimization/parameter block 808. A norm of the squared error is given as:

$$\epsilon=\|e\|^2=\|x_w-\beta Hc_\tau-\gamma Hc_k\|^2. \tag{7}$$

Due to complexity limitations, practical implementations of speech coding systems typically minimize the squared error in a sequential fashion. That is, the ACB component is optimized first (by assuming the FCB contribution is zero), and then the FCB component is optimized using the given (previously optimized) ACB component. The ACB/FCB gains, that is, codebook-related parameters β and γ, may or may not be re-optimized, that is, quantized, given the sequentially selected ACB/FCB code-vectors $c_\tau$ and $c_k$.

The theory for performing the sequential search is as follows. First, the norm of the squared error as provided in Equation 7 is modified by setting γ=0, and then expanded to produce:

$$\epsilon=\|x_w-\beta Hc_\tau\|^2=x_w^Tx_w-2\beta x_w^THc_\tau\beta^2c_\tau^TH^THc_\tau. \tag{8}$$

Minimization of the squared error is then determined by taking the partial derivative of ϵ with respect to β and setting the quantity to zero:

$$\frac{\partial\varepsilon}{\partial\beta} = x_w^THc_\tau - \beta c_\tau^TH^THc_\tau = 0. \tag{9}$$

This yields an (sequentially) optimal ACB gain:

$$\beta = \frac{x_w^THc_\tau}{c_\tau^TH^THc_\tau}. \tag{10}$$

Substituting the optimal ACB gain back into Equation 8 gives:

$$\tau^* = \underset{\tau}{\operatorname{argmin}}\left\{x_w^Tx_w - \frac{(x_w^THc_\tau)^2}{c_\tau^TH^THc_\tau}\right\}, \tag{11}$$

where τ* is a sequentially determined optimal ACB index parameter, that is, an ACB index parameter that minimizes the bracketed expression. Since $x_w$ is not dependent on τ, Equation 11 can be rewritten as follows:

$$\tau^* = \underset{\tau}{\operatorname{argmax}}\left\{\frac{(x_w^THc_\tau)^2}{c_\tau^TH^THc_\tau}\right\}. \tag{12}$$

Now, by letting $y_\tau$ equal the ACB code-vector $C_\tau$ filtered by weighted synthesis filter 803, that is, $y_\tau=Hc_\tau$, Equation 13 can be simplified to:

$$\tau^* = \underset{\tau}{\operatorname{argmax}}\left\{\frac{(x_w^Ty_\tau)^2}{y_\tau^Ty_\tau}\right\}, \tag{13}$$

and likewise, Equation 10 can be simplified to:

$$\beta = \frac{x_w^T y_\tau}{y_\tau^T y_\tau}. \tag{14}$$

Thus Equations 13 and 14 represent the two expressions necessary to determine the optimal ACB index $\tau$ and ACB gain $\beta$ in a sequential manner. These expressions can now be used to determine the optimal FCB index and gain expressions. First, from FIG. 8, it can be seen that a second combiner 806 produces a vector $x_2$, where $x_2=x_w-\beta Hc_\tau$. The vector $x_w$ is produced by a first combiner 805 that subtracts a past excitation signal u(n−L), after filtering by a weighted synthesis filter 801, from an output $s_w(n)$ of a perceptual error weighting filter 802. The term $\beta Hc_\tau$ is a filtered and weighted version of ACB code-vector $c_\tau$, that is, ACB code-vector $c_\tau$ filtered by weighted synthesis filter 803 and then weighted based on ACB gain parameter $\beta$. Substituting the expression $x_2=x_w-\beta Hc_\tau$ into Equation 7 yields:

$$\epsilon=\|x_2-\gamma Hc_k\|^2. \tag{15}$$

where $\gamma Hc_k$ is a filtered and weighted version of FCB code-vector $c_k$, that is, FCB code-vector $c_k$ filtered by weighted synthesis filter 804 and then weighted based on FCB gain parameter $\gamma$. Similar to the above derivation of the optimal ACB index parameter $\tau^*$, it is apparent that:

$$k^* = \underset{k}{\operatorname{argmax}}\left\{\frac{(x_2^T Hc_k)^2}{c_k^T H^T Hc_k}\right\}, \tag{16}$$

where k* is the optimal FCB index parameter, that is, an FCB index parameter that maximizes the bracketed expression. By grouping terms that are not dependent on k, that is, by letting $d_2^T=x_2^T H$ and $\Phi=H^T H$, Equation 16 can be simplified to:

$$k^* = \underset{k}{\operatorname{argmax}}\left\{\frac{(d_2^T c_k)^2}{c_k^T \Phi c_k}\right\}, \tag{17}$$

in which the optimal FCB gain $\gamma$ is given as:

$$\gamma = \frac{d_2^T c_k}{c_k^T \Phi c_k}. \tag{18}$$

Figure 9:
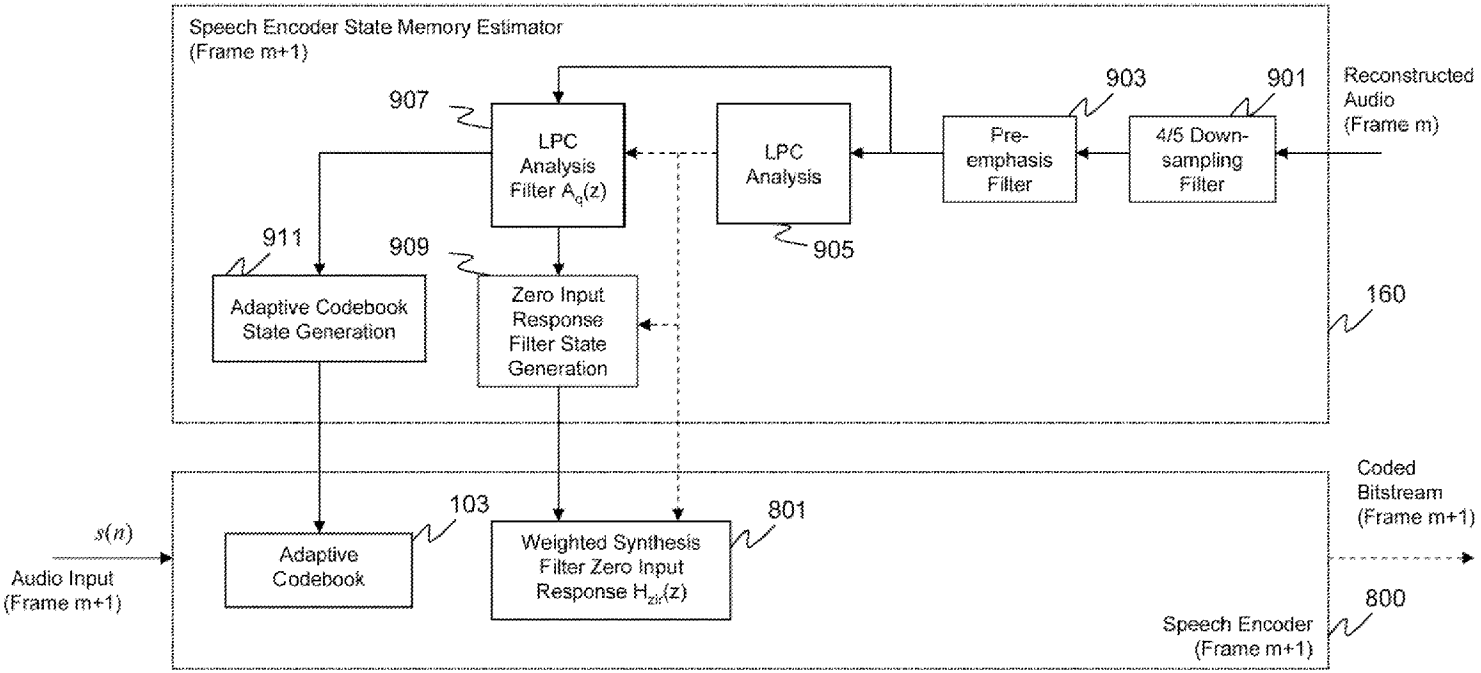
FIG. 9 is a block diagram of a state generator in accordance with an alternate embodiment of the present invention.

Like encoder 130, encoder 800 requires initialization states supplied from state generator 160. This is illustrated in FIG. 9. showing an alternate embodiment for state generator 160. As shown in FIG. 9 the input to adaptive codebook 103 is obtained from block 911 in FIG. 9), and the weighted synthesis filter 801 utilizes the output of block 909 which in turn utilizes the output of block 905.

So far we have discussed the switching from audio mode to speech mode when the speech mode codec is AMR-WB codec. The ITU-T G.718 codec and can similarly be used as a speech mode codec in the hybrid codec. The G.718 codec classifies the speech frame into four modes:

a. Voiced Speech Frame;
b. Unvoiced Speech Frame;
c. Transition Speech Frame; and
d. Generic Speech Frame.

The Transition speech frame is a voiced frame following the voiced transition frame. The Transition frame minimizes its dependence on the previous frame excitation. This helps in recovering after a frame error when a voiced transition frame is lost. To summarize, the transform domain frame output is analyzed in such a way to obtain the excitation and/or other parameters of the CELP domain codec. The parameters and excitation should be such that they should be able to generate the same transform domain output when these parameters are processed by the CELP decoder. The decoder of the next frame which is a CELP (or time domain) frame uses the state generated by the CELP decoder processing of the parameters obtained during analysis of the transform domain output.

To decrease the effect of state update on the subsequent voiced speech frame during audio to speech mode switching, it may be preferable to code the voiced speech frame following an audio frame as a transition speech frame.

It can be observed that in the preferred embodiment of the hybrid codec, where the down-sampling/up-sampling is performed only in the speech mode, the first L output samples generated by the speech mode during audio to speech transition are also generated by the audio mode. (Note that audio codec was delayed by the length of the down sampling filter). The state update discussed above provides a smooth transition. To further reduce the discontinuities, the L audio mode output samples can be overlapped and added with the first L speech mode audio samples.

Figure 10:
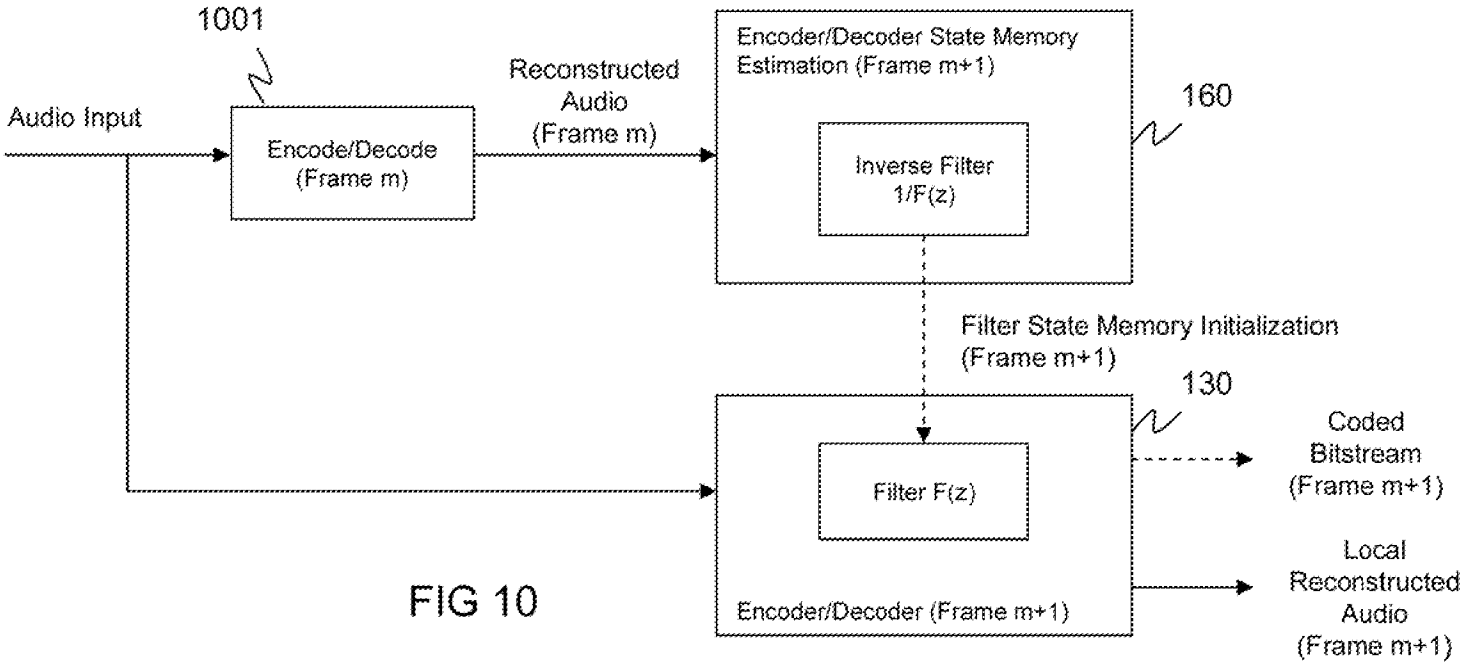
FIG. 10 is a block diagram of a speech encoder in accordance with a further embodiment of the present invention.

In some situations, it is required that the decoding should also be performed at the encoder side. For example, in a multi-layered codec (G.718), the error of the first layer is coded by the second layer and hence the decoding has to be performed at the encoder side. FIG. 10 specifically addresses the case where the first layer of a multilayer codec is a hybrid speech/audio codec. The audio input from frame m is processed by the generic audio encoder/decoder 1001 where the audio is encoded via an encoder, and then immediately decoded via a decoder. The reconstructed (decoded) generic audio from block 1001 is processed by a state generator 160. The state estimation from state generator 160 is now used by the speech encoder 130 to generate the coded speech.

Figure 11:
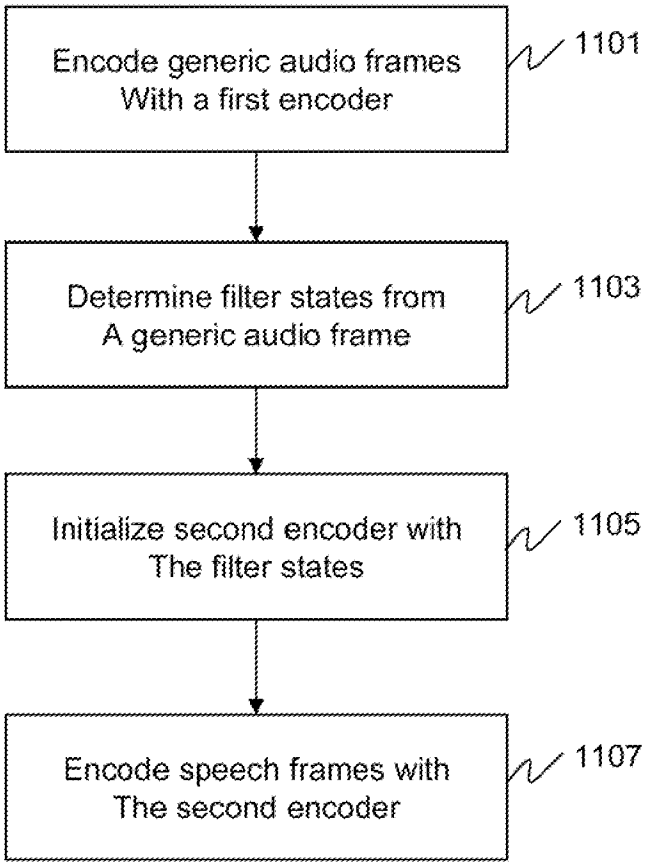
FIG. 11 is a flow chart showing operation of the encoder of FIG. 1.

FIG. 11 is a flow chart showing operation of the encoder of FIG. 1. As discussed above, the encoder of FIG. 1 comprises a first coder encoding generic audio frames, a state generator outputting filter states for a generic audio frame m, and a second encoder for encoding speech frames. The second encoder receives the filter states for the generic audio frame m, and using the filter states for the generic audio frame m encodes a speech frame m+1.

The logic flow begins at step 1101 where generic audio frames are encoded with a first encoder (encoder 140). Filter states are determined by state generator 160 from a generic audio frame (step 1103). A second encoder (speech coder 130) is then initialized with the filter states (step 1105). Finally, at step 1107 speech frames are encoded with the second encoder that was initialized with the filter states.

Figure 12:
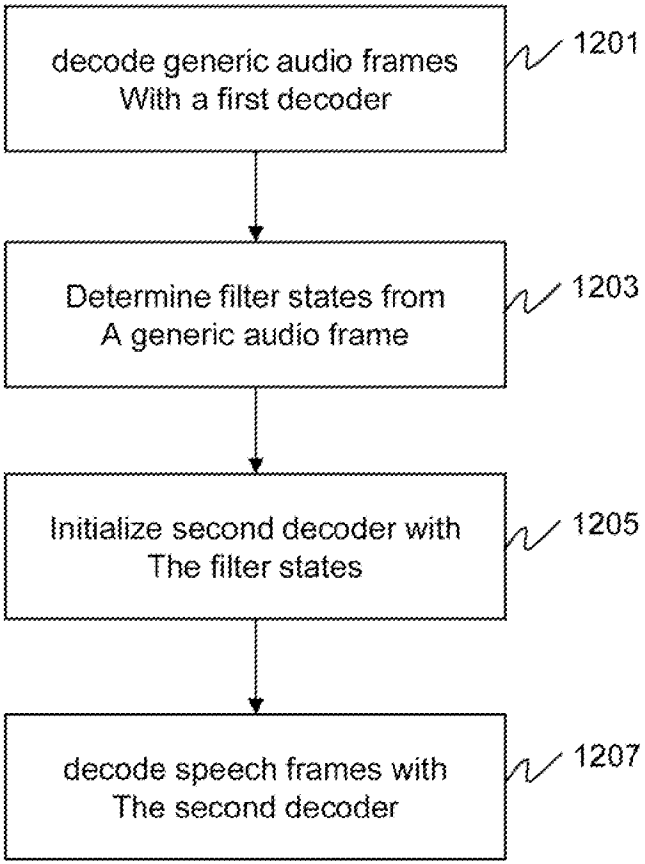
FIG. 12 is a flow chart showing operation of the decoder of FIG. 2.

FIG. 12 is a flow chart showing operation of the decoder of FIG. 2. As discussed above, the decoder of FIG. 2 comprises a first decoder 221 decoding generic audio frames, a state generator 260 outputting filter states for a generic audio frame m, and a second decoder 230 for decoding speech frames. The second decoder receives the filter states for the generic audio frame m and uses the filter states for the generic audio frame m to decode a speech frame m+1.

The logic flow begins at step 1201 generic audio frames are decoded with a first decoder (encoder 221). Filter states are determined by state generator 260 from a generic audio frame (step 1203). A second decoder (speech decoder 230) is then initialized with the filter states (step 1205). Finally, at step 1207 speech frames are decoded with the second decoder that was initialized with the filter states.

While the invention has been particularly shown and described with reference to a particular embodiment, it will be understood by those skilled in the art that various changes in form and details may be made therein without departing from the spirit and scope of the invention. For example, although many states/parameters were described above being generated by circuitry 260 and 360, one or ordinary skill in the art will recognize that fewer or more parameters may be generated than those shown. Another example may entail a second encoder/decoder method that may use an alternative transform coding algorithm, such as on based on a discreet Fourier transform (DFT) or a fast implementation thereof. Other coding methods are anticipated as well, since there are no real limitations except that the reconstructed audio from a previous frame is used as input to the encoder/decoder state state generators. Furthermore, state update of a CELP type speech encoder/decoder are presented, however, it may also be possible to use another type of encoder/decoder for processing of the frame m+1. It is intended that such changes come within the scope of the following claims:

The invention claimed is:

1. A method for decoding audio frames, the method comprising the steps of:

decoding a first audio frame with a first decoder to produce a first reconstructed audio signal:

determining a filter state for a second decoder from the first reconstructed audio signal, wherein determining the filter state for the second decoder comprises determining an inverse of the filter state that is initialized in the second decoder;

back-propagating the first reconstructed audio signal to the second decoder via the inverse of the filter corresponding to the second decoder;

transferring the determined filter state to the filter corresponding to the second decoder;

initializing the second decoder with the filter state determined from the first reconstructed audio signal; and decoding speech frames with the second decoder initialized with the filter state wherein: the step of determining the filter state comprises performing at least one of down sampling of the reconstructed audio signal and pre-emphasis of the reconstructed audio signal; and the step of initializing the second decoder with the filter state is accomplished by receiving at least one of an upsampling filter state and a de-emphasis filter state.

2. The method of claim 1 wherein the filter state comprises at least one of a Re-sampling filter sate memory a Pre-emphasis/de-emphasis filter state memory a Linear prediction (LP) coefficients for interpolation a Weighted synthesis filter state memory a Zero input response state memory an Adaptive codebook (ACB) state memory an LPC synthesis filter state memory a Postfilter state memory a Pitch pre-filter state memory.

3. The method of claim 1 wherein the first decoder comprises a generic-audio decoder encoding less speech-like frames.

4. The method of claim 2 wherein the first decoder comprises a Modified Discrete Cosine Transform (MDCT) decoder.

5. The method of claim 2 wherein the second decoder comprises a speech decoder decoding more speech-like frames.

6. The method of claim 5 wherein the second decoder comprises Code Excited Linear Predictive (CELP) coder.

7. A method for encoding audio frames, the method comprising the steps of:

encoding generic audio frames with a first encoder;

determining filter states for a second encoder from a generic audio frame, wherein determining the filter states for the second encoder comprises determining an inverse of the filter state that is initialized in the second encoder;

back-propagating the encoded generic audio frames to the second encoder via the inverse of the filter corresponding to the second encoder, transferring the determined filter states to the filter corresponding to the second encoder;

initializing the second encoder with the filter states determined from the generic-audio frame; and encoding speech frames with the second encoder initialized with the filter states wherein:

the step of determining the filter state comprises performing at least one of up sampling of the reconstructed audio signal and de-emphasis of the audio signal; and the step of initializing the second encoder with the filter state is accomplished by receiving at least one of the downsampling filter state and a pre-emphasis filter state.

* * * * *